US010170269B2

(12) United States Patent
Kamiyama et al.

(10) Patent No.: US 10,170,269 B2
(45) Date of Patent: Jan. 1, 2019

(54) MAGNETRON HAVING A COOLING STRUCTURE

(71) Applicant: Hitachi Power Solutions Co., Ltd., Hitachi-shi, Ibaraki (JP)

(72) Inventors: Kentaro Kamiyama, Ibaraki (JP); Reiji Torai, Ibaraki (JP)

(73) Assignee: Hitachi Power Solutions Co., Ltd., Hitachi-shi (JP)

( * ) Notice: Subject to any disclaimer, the term of this patent is extended or adjusted under 35 U.S.C. 154(b) by 0 days.

(21) Appl. No.: 15/718,551

(22) Filed: Sep. 28, 2017

(65) Prior Publication Data

US 2018/0096815 A1 Apr. 5, 2018

(30) Foreign Application Priority Data

Sep. 30, 2016 (JP) ..... 2016-194381

(51) Int. Cl.
*H01J 23/00* (2006.01)
*H01J 23/20* (2006.01)
*H01J 25/50* (2006.01)

(52) U.S. Cl.
CPC ..... *H01J 23/005* (2013.01); *H01J 23/20* (2013.01); *H01J 25/50* (2013.01)

(58) Field of Classification Search
CPC ..... H01J 23/005; H01J 23/20; H01J 25/50
USPC ..... 315/39.75
See application file for complete search history.

(56) References Cited

U.S. PATENT DOCUMENTS 9,035,551 B2 * 5/2015 Miyamoto ..... H01J 23/20 315/39.51

FOREIGN PATENT DOCUMENTS

| | | | | |
|---|---|---|---|---|
| GB | 2 259 605 A | | 3/1993 | |
| GB | 2259605 A | * | 3/1993 | ..... H01J 23/005 |
| JP | 172481 B | | 4/1946 | |
| JP | 56-26340 A | | 3/1981 | |
| JP | 2005-209426 A | | 8/2005 | |
| JP | 2014-165032 A | | 9/2014 | |

* cited by examiner

*Primary Examiner* — Daniel D Chang
(74) *Attorney, Agent, or Firm* — Crowell & Moring LLP

(57) ABSTRACT

A magnetron includes an anode cylinder extending in a cylindrical shape along a central axis and a plurality of plate-like vanes at least each one end of which is fixed to the anode cylinder, extending from an inner face of the anode cylinder toward the central axis, in which the anode cylinder includes refrigerant flow paths for directly applying a refrigerant to the plate-like vanes. The refrigerant flow paths 111 are openings formed so that end surfaces (joint end faces of the plate-like vanes) of the plate-like vanes are exposed, which allow the refrigerant to directly contact the plate-like vanes.

11 Claims, 7 Drawing Sheets

MAGNETRON HAVING A COOLING STRUCTURE

TECHNICAL FIELD

The present invention relates to a magnetron that is an electron tube generating microwaves.

BACKGROUND ART

As the magnetron is generally capable of generating high-frequency output efficiently, it is widely used for a radar apparatus, medical equipment, cooking apparatuses such as a microwave oven, semiconductor manufacturing equipment and other fields such as microwave application devices. High-output microwaves are required for the semiconductor manufacturing equipment and for industrial heating. In such cases, it is necessary to improve cooling performance of the magnetron so as to correspond to the output of microwaves, therefore, it is necessary to increase cooling ability. However, the increase in cooling ability leads to the size increase of the magnetron, which causes increase of a space for housing the magnetron and increase of the device itself, therefore, a small-sized magnetron having a cooling structure with excellent performance is required.

In Patent Literature 1, a magnetron having a cooling block is described, which is closely disposed on an outer wall of an anode cylinder and has plural flow paths for a cooling medium (hereinafter referred to as a refrigerant) thereinside along a tube axis direction of the anode cylinder.

CITATION LIST

Patent Literature

Patent Literature 1: JP2005-209426A

SUMMARY OF INVENTION

Technical Problem

However, in the magnetron described in Patent Literature 1, there is a problem that it is difficult to effectively cool plate-like vanes with the highest heating value. It is difficult to effectively cool the vanes particularly in a high-output type magnetron with an output of 10 kW or more.

The present invention has been made in view of the above circumstances, and an object thereof is to provide a magnetron that effectively cools plate-like vanes.

Solution to Problem

In order to solve the above problem, a magnetron according to the present invention includes an anode cylinder extending in a cylindrical shape along a central axis and a plurality of plate-like vanes at least each one end of which is fixed to the anode cylinder, extending from an inner face of the anode cylinder toward the central axis, in which the anode cylinder includes refrigerant flow paths for directly applying a refrigerant to the plate-like vanes.

Advantageous Effects of Invention

According to the present invention, it is possible to provide a magnetron capable of cooling the plate-like vanes effectively.

DESCRIPTION OF EMBODIMENTS

Hereinafter, embodiments of the present invention will be explained in detail with reference to the drawings.

(First Embodiment)

Figure 1:
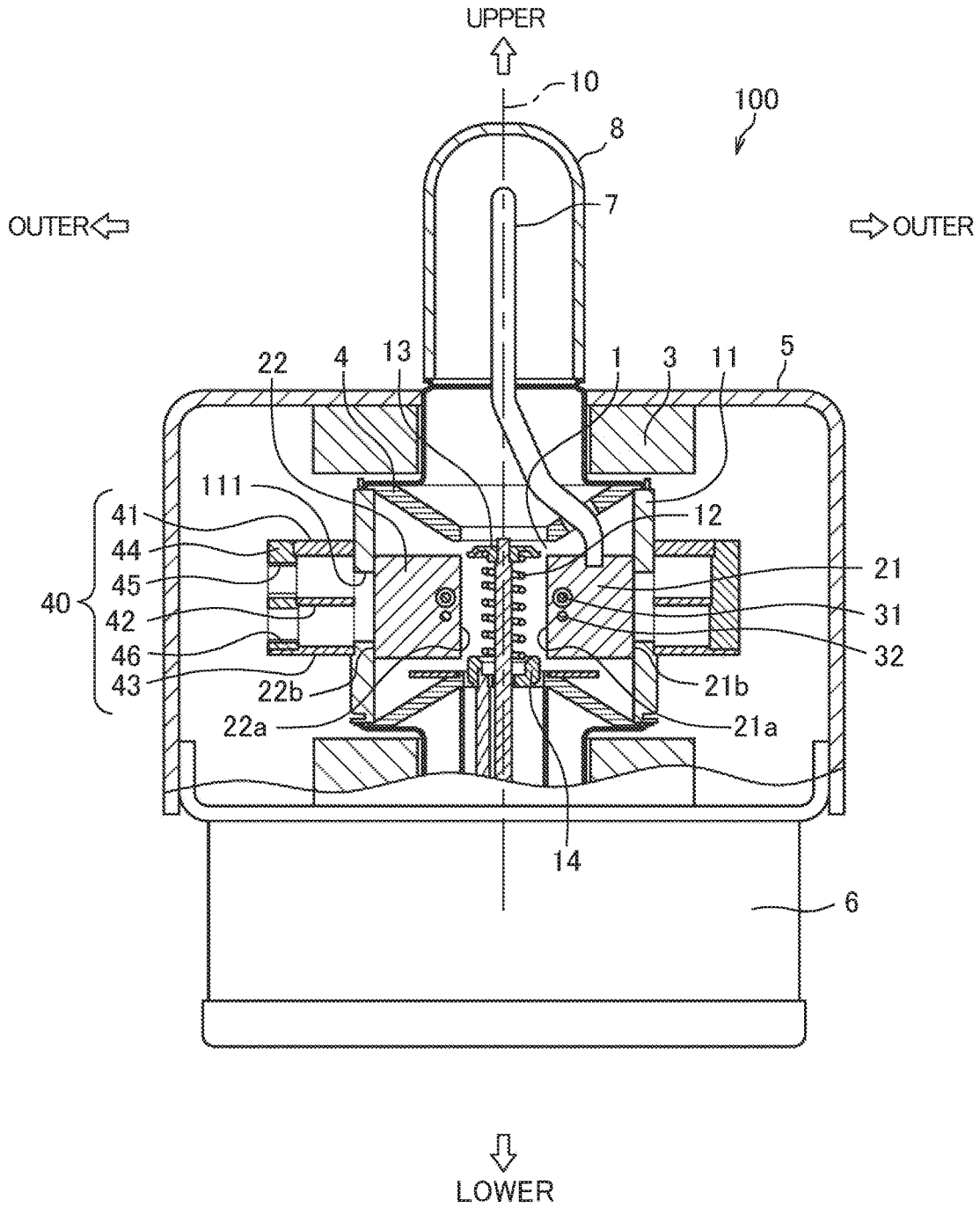
FIG. 1 is a view showing a configuration of a magnetron according to a first embodiment of the present invention.
Figure 2:
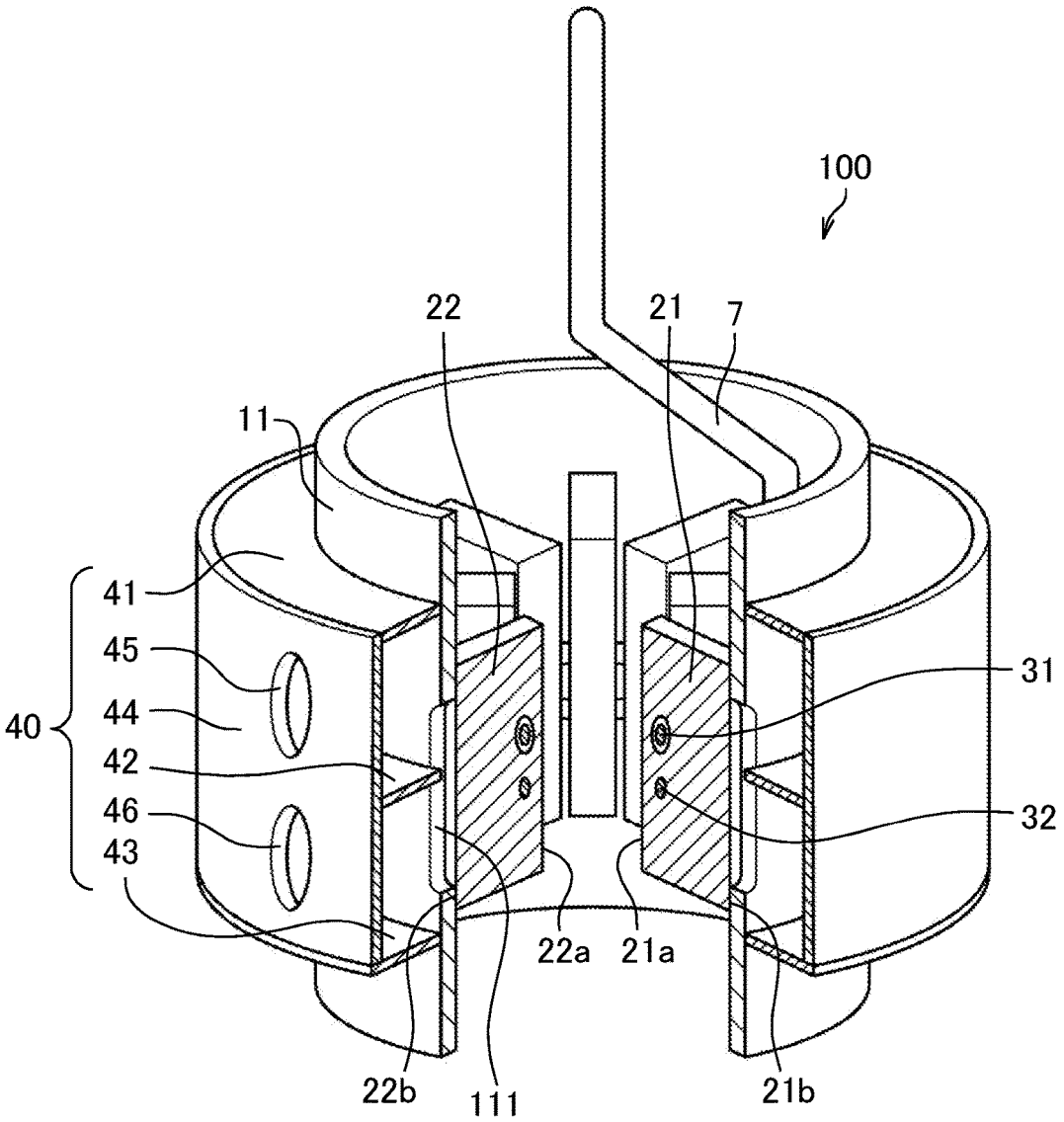
FIG. 2 is a perspective view showing an anode portion and a cooling jacket of the magnetron according to the first embodiment seen from an upper-face side.
Figure 3:
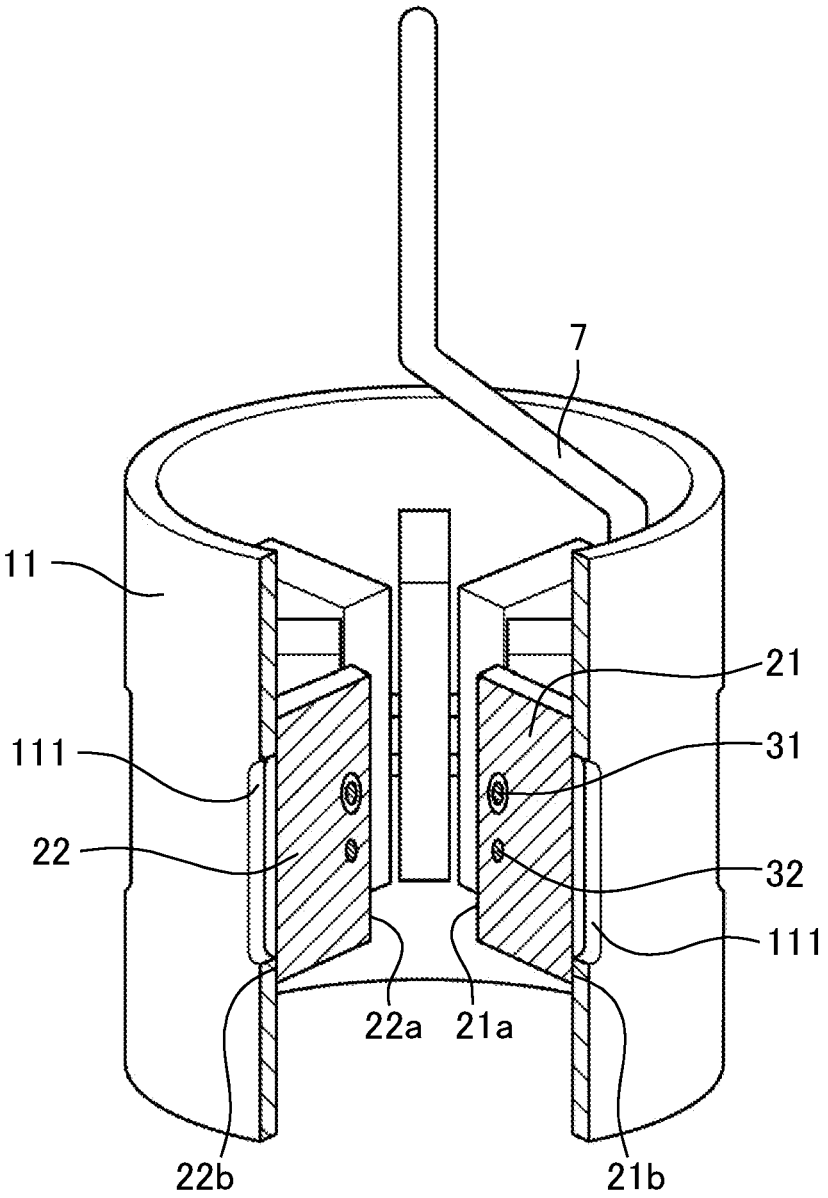
FIG. 3 is a perspective view showing the anode portion of the magnetron according to the first embodiment seen from the upper-face side.
Figure 4:
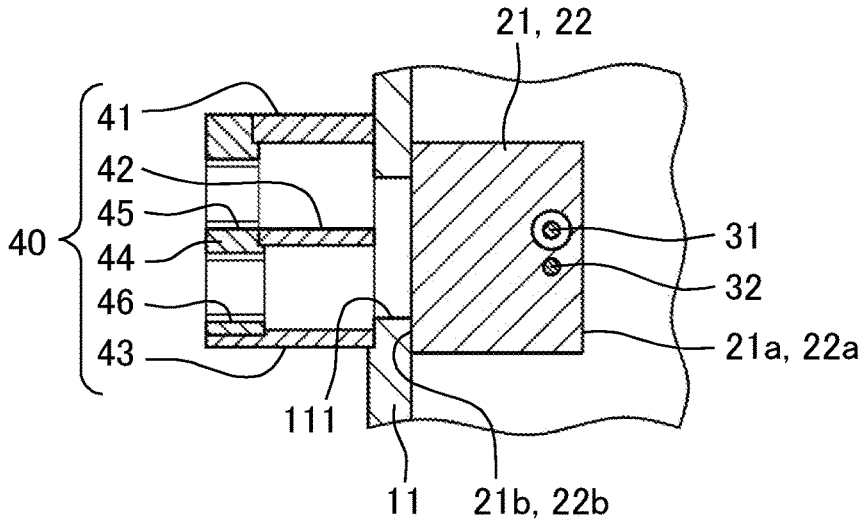
FIG. 4 is a cross-sectional view of a relevant part of the anode portion of the magnetron according to the first embodiment.

FIG. 1 is a view showing a configuration of a magnetron according to a first embodiment of the present invention. FIG. 2 is a perspective view showing an anode portion and a cooling jacket of the magnetron seen from an upper-face side. FIG. 3 is a perspective view showing the anode portion of the magnetron seen from the upper-face side. FIG. 4 is a cross-sectional view of a relevant part of the anode portion of the magnetron. The magnetron according to the embodiment is an example in which the present invention is applied to a magnetron used for, for example, a microwave oscillator for industrial use.

As shown in FIG. 1, a magnetron 100 includes a vacuum tube portion 1 arranged in a central part, a cooling jacket 40 (refrigerant supply portion) arranged in an outer peripheral part of an anode cylinder 11 forming the vacuum tube portion 1, a pair of annular magnets (magnets) 3 coaxially arranged with the vacuum tube portion 1, a pair of magnetic poles 4 that magnetically connect the annular magnets 3, a frame yoke (yoke) 5 in which the annular magnets 3 form a magnetic circuit, a filter circuit portion 6, an antenna 7 and an antenna cover 8. The filter circuit portion 6 includes a choke coil (not shown). The antenna 7 and the antenna cover 8 configure an output portion with a not-shown insulator.

The vacuum tube 1 includes a cylindrical anode cylinder 11, a cathode 12 coaxially arranged with the anode cylinder 11 and to be a thermionic emission source, a pair of end hats 13, 14, plural plate-like vanes 21, 22 that are radially arranged around a central axis 10 of the anode cylinder 11, a plurality of strap rings 31, 32 for electrically connecting the plate-like vanes alternately, and the antenna 7 for emitting microwaves, one end of which is connected to any one of plate-like vanes 21, 22. The anode cylinder 11 extends in a cylindrical shape along the central axis 10. The antenna 7 has a bar shape made of copper, which is drawn from any one of the plate-like vanes 21, 22. The antenna 7 extends inside the output portion along the central axis.

As shown in FIG. 2 to FIG. 4, the anode cylinder 11 includes refrigerant flow paths 111 for directly applying (making contact with) a refrigerant (a cooling liquid, for example, a coolant) to the plate-like vanes 21, 22. Specifically, the anode cylinder 11 includes the refrigerant flow paths 111 for directly supplying the refrigerant to the plate-like vanes 21, 22 so as to match with positions corresponding to fixed portions of the plate-like vanes 21, and shapes thereof. In the present embodiment, the refrigerant flow paths 111 open in a slit shape so as to correspond to shapes of end faces 21*b*, 22*b* (joint end faces of the plate-like vanes 21, 22) of the plate-like vanes 21, 22 in an outer peripheral part of the anode cylinder 11.

The refrigerant flow paths 111 are groove-shaped flow paths formed by drilling (excavating) the inside of the anode cylinder 11 from the outer peripheral part of the anode cylinder 11 toward an inner peripheral part in which the plate-like vanes 21, 22 are fixed. The refrigerant flow paths 111 are openings where end portions of the plate-like vanes 21, 22 are exposed, in which the refrigerant (cooling liquid) can be directly brought into contact with the plate-like vanes 21, 22.

Although the refrigerant flow paths 111 are provided by drilling the inside of the anode cylinder 11 from the outer peripheral part to reach end faces of the plate-like vanes 21, 22, the refrigerant flow paths 111 do not communicate with an internal space of the anode cylinder 11 at portions other than fixed portions of the plate-like vanes 21, 22. That is, the refrigerant flow paths 111 are formed so that prescribed unexposed portions (joint end faces) remain from the central part to upper and lower as well as right and left portions in end faces of the plate-like vanes 21, 22. Accordingly, the anode cylinder body 11 can maintain airtightness (vacuum state) thereinside even when the refrigerant flow paths 111 are provided.

As shown in FIG. 1 to FIG. 3, an even number of plate-like vanes 21, 22 are arranged radially and at equal intervals with respect to the central axis 10 of the anode cylinder body 11, and closely contact the inner peripheral part of the anode cylinder 11. The plate-like vanes 21, 22 extend from the vicinity of the central axis 10 almost radially and fixed to an inner face of the anode cylinder body 11.

The plate-like vanes 21, 22 are respectively formed in a substantially rectangular plate shape. End faces (free ends) 21*a*, 22*a* of the plate-like vanes 21, 22 on the side not fixed to the inner face of the anode cylinder 11 are arranged on the same cylinder surface extending along the central axis 10, and the inner face is called a vane inscribed cylinder. The plural plate-like vanes 21, 22 are connected by the strap rings 31, 32 paired in a vertical direction, which are brazed to end portions on an output side (upper side in FIG. 1) of the vanes alternately in a circumferential direction. These plate-like vanes 21, 22 are also connected by the strap rings 31, 32 paired in the vertical direction, which are brazed to end portions on an input side (lower side in FIG. 1) alternately in a circumferential direction. The strap rings 31, 32 electrically connect these plate-like vanes 21, 22 alternately. Incidentally, a resonance frequency of the magnetron varies also by a state of brazing of the plate-like vanes 21, 22.

As shown in FIG. 1 and FIG. 2, the cooling jacket 40 is arranged in the outer peripheral part of the anode cylinder 11. The cooling jacket 40 is a cooling portion for cooling an oscillator body provided inside a space surrounded by the fame yoke 5, which brings a circulating refrigerant into contact with the anode portion. The cooling jacket 40 includes an annular jacket upper plate 41, an annular jacket middle plate 42, an annular jacket lower plate 43 and a jacket outer cylinder 44. Components of the cooling jacket 40 are joined to one another, and the cooling jacket 40 and the anode cylinder 11 are joined respectively. In the jacket outer cylinder 44, a feed port 45 from which the refrigerant (cooling liquid) is supplied and an outlet port 46 from which the circulated refrigerant is discharged are formed at upper and lower two places of the jacket middle plate 42. The feed port 45 and the outlet port 46 may be provided opposingly at either upper and lower positions of the jacket middle plate 42. Not-shown pipelines are connected to the feed port 45 and the outlet port 46. The upper and lower positions of the feed port 45 and the outlet port 46 may be displaced from a viewpoint of easiness of attaching and arranging the pipelines (not shown).

As shown in FIG. 1, the cathode 12 has a spiral shape, and is arranged on the central axis 10 of the anode cylinder 11. Both ends of the cathode 12 are fixed to the end hats 13, 14 respectively. The end hats 13, 14 are arranged outside the central axis 10 with respect to the plate-like vanes 21, 22.

The annular magnet 3 and the frame yoke 5 are arranged so as to surround the oscillator body to form a magnetic circuit. In the cathode 12, the filter circuit 6 having a coil and a feed-through capacitor (not shown) is connected through a not-shown support rod.

At the time of operation of the magnetron 1, a high-frequency electric field generated in the anode tube is taken out by the antenna 7 and is outputted to the outside as microwaves.

Hereinafter, a cooling operation of the magnetron 100 configured as described above will be explained.

When the cooling liquid is supplied to the pipeline (not shown) connected to a not-shown supply pipe, the cooling liquid flows into the feed port 45 of the jacket outer cylinder 44 of the cooling jacket 40 as shown in FIG. 2.

The cooling liquid flowing into the cooling jacket 40 flows into an annular water passage formed by the jacket upper plate 41, the jacket middle plate 42, the jacket outer tube 44 and the anode cylinder 11.

The cooling liquid flowing into the annular water passage also flows into the refrigerant flow paths 111 opened in the anode cylinder 11, directly abutting on the slit-shaped end faces 21*b*, 22*b* of the plate-like vanes 21, 22 exposed on the anode cylinder 11 side and directly cooling the slit-shaped end faces 21*b*, 22*b* of the plate-like vanes 21, 22 by the cooling liquid (see FIG. 4). As the end faces 21*b*, 22*b* of the plate-like vanes 21, 22 are directly cooled, the entire plate-like vanes 21, 22 can be cooled efficiently.

Then, the cooling liquid circulating inside the cooling jacket 40 is discharged from the outlet port 46 of the jacket outer cylinder 44, being circulated to an outer heat exchanger (not shown) through a not-shown discharge pipe finally and cooled again to be supplied to the supply pipe (not shown).

As explained above, the magnetron 100 according to the embodiment includes the anode cylinder 11 extending in the cylindrical shape along the central axis 10 and plural plate-like vanes 21, 22 at least each one end of which is fixed to the anode cylinder 11 and extending from the inner face of the anode cylinder 11 toward the central axis 10. The anode cylinder 11 has the refrigerant flow paths 111 for directly applying the refrigerant to the plate-like vanes 21, 22. The refrigerant flow paths 111 are openings in which the end faces 21*b*, 22*b* (joint end faces of the plate-like vanes 21, 22) of the plate-like vanes 21, 22 are exposed, which allow the refrigerant (cooling liquid) to directly contact the plate-like vanes 21, 22.

According to the above structure, the plate-like vanes 21, 22 with the highest heating value can be effectively cooled by directly applying the refrigerant to the plate-like vanes 21, 22. In particular, it is suitable to be applied to a high-output type magnetron with an output of 10 kW or more.

The magnetron 100 according to the present embodiment can be also applied to a magnetron with an output of 10 kW or less. That is, the magnetron can be applied to magnetrons with any output without changing the structure, therefore, the invention can respond to output change or change in application conditions as well as replacement (displacement) that may occur in the future, and versatility can be drastically increased.

Figure 5:
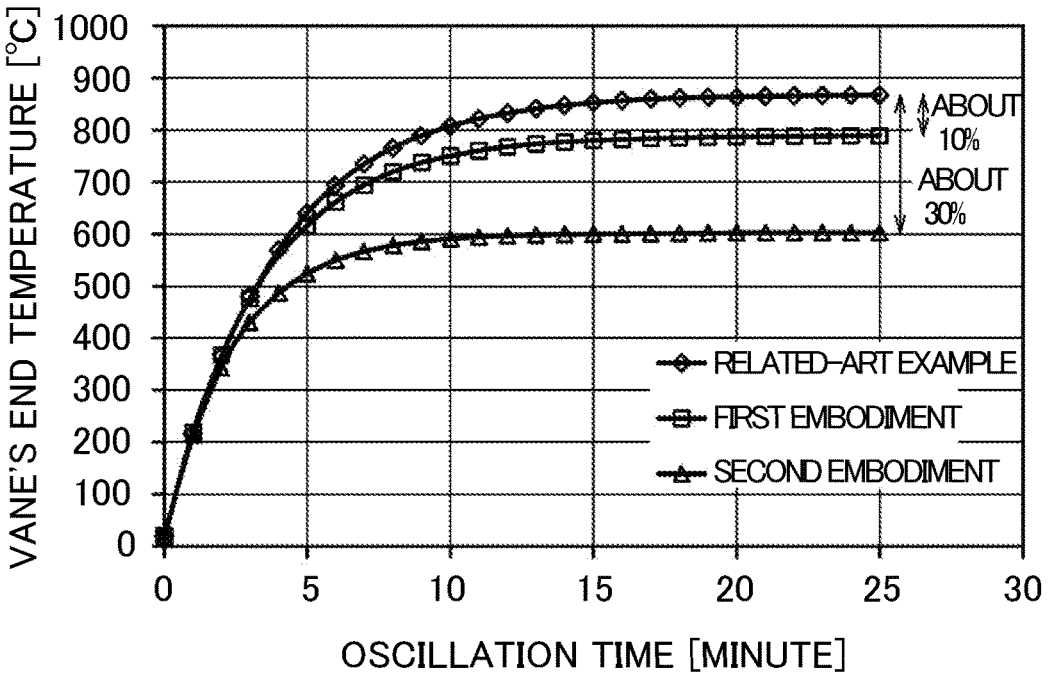
FIG. 5 is a graph for explaining effects obtained when the magnetron according to the embodiment is applied to a high-output (15 kW) magnetron.

FIG. 5 is a graph for explaining effects obtained when the magnetron according to the present embodiment is applied to a high-output (15 kW) magnetron. In FIG. 5, the vertical axis represents the temperature [° C.] in ends of the plate-like vanes 21, 22 (vicinities of vanes facing the central axis 10) and the horizontal axis represents the oscillation time [minute].

As shown in FIG. 5, the increase in temperature at ends of the plate-like vanes 21, 22 is suppressed in the same conditions in the present embodiment (see symbols □ in FIG. 5) with respect to a related-art example (see symbols ◇ in FIG. 5), and it is confirmed that a saturation temperature is improved 10%.

(Second Embodiment)

Figure 6:
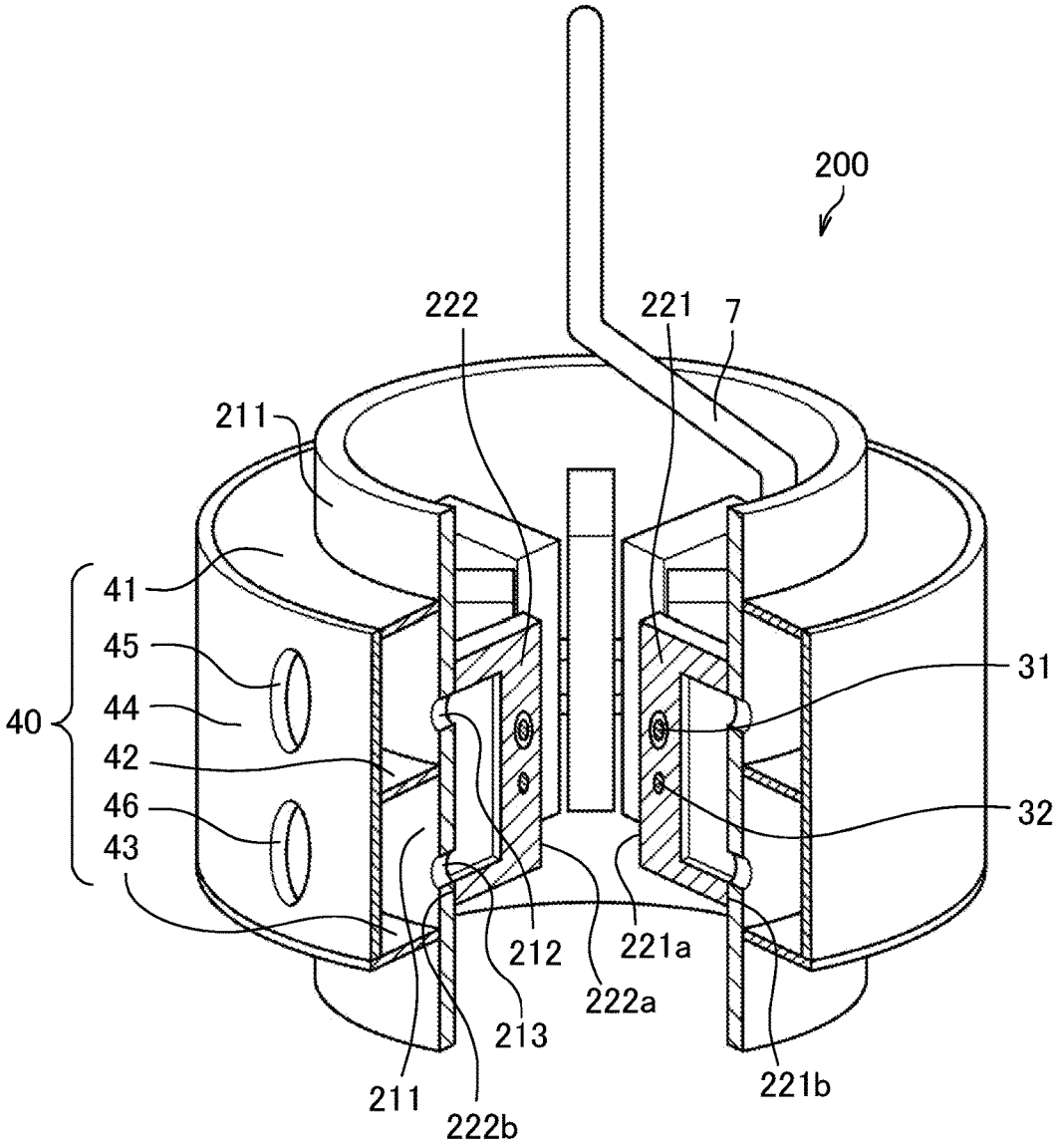
FIG. 6 is a perspective view showing an anode portion and a cooling jacket of a magnetron according to a second embodiment of the present invention seen from an upper-face side.
Figure 7:
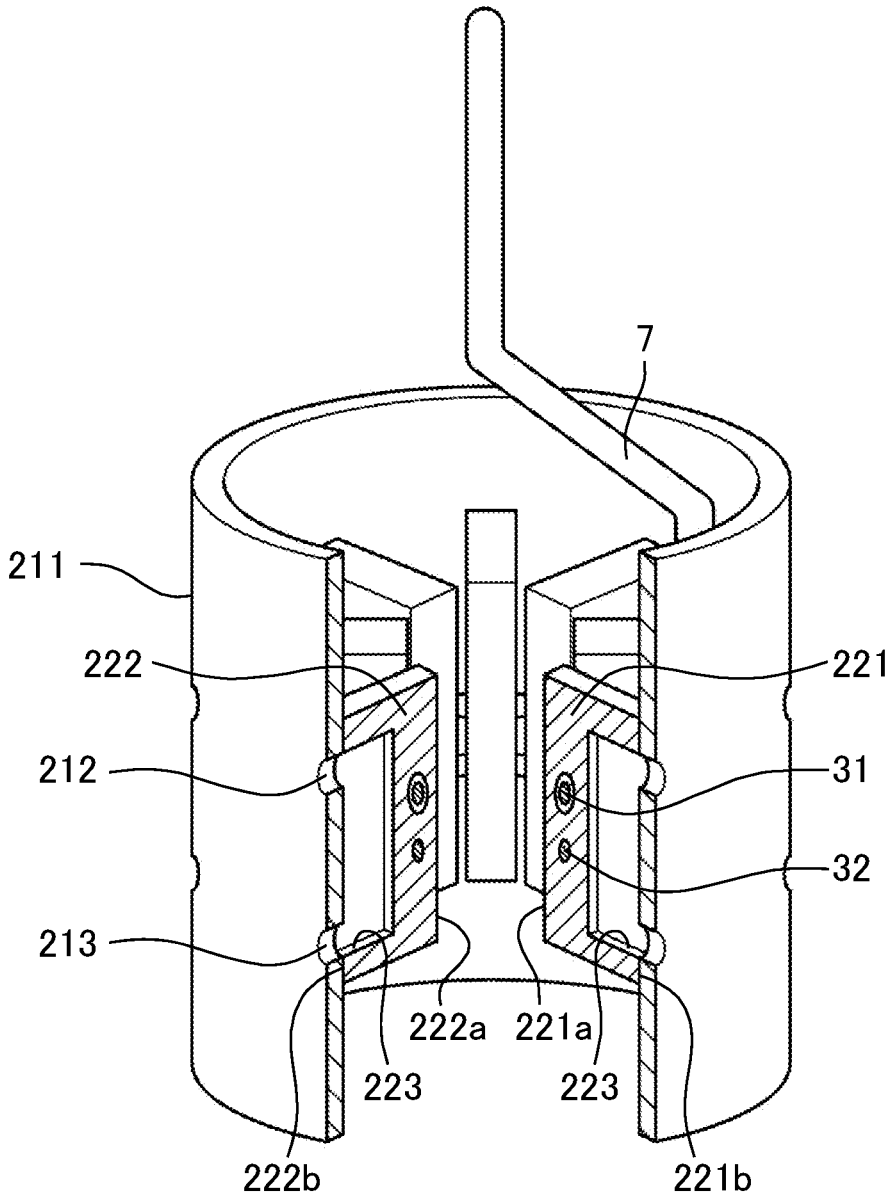
FIG. 7 is a perspective view of the anode portion of the magnetron according to the above-mentioned second embodiment seen from the upper-face side.
Figure 8:
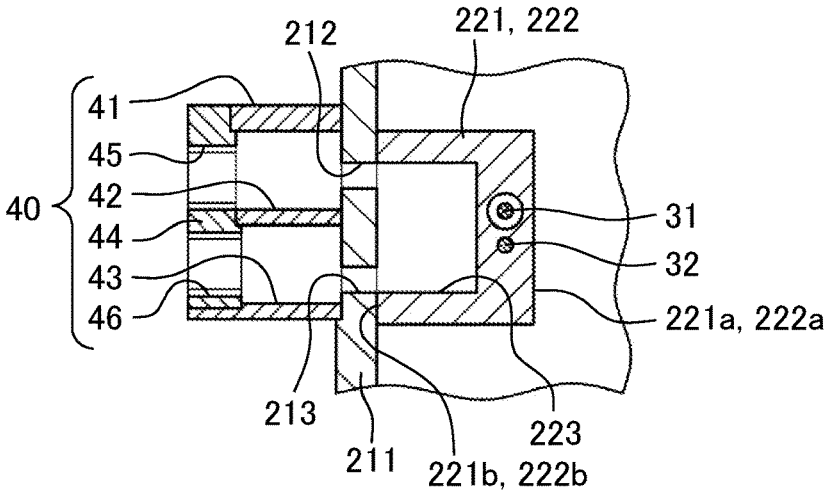
FIG. 8 is a cross-sectional view of a relevant part of the anode portion of the magnetron according to the above-mentioned second embodiment.

FIG. 6 is a perspective view showing an anode portion and a cooling jacket of a magnetron according to a second embodiment of the present invention seen from an upper-face side. FIG. 7 is a perspective view of the anode portion of the magnetron seen from the upper-face side. FIG. 8 is a cross-sectional view of a relevant part of the anode portion of the magnetron. The same symbols are added to the same components as those of FIG. 1 to FIG. 4 and explanation of repeated portions is omitted.

As shown in FIG. 6, a magnetron 200 includes a cylindrical anode cylinder 211, plural plate-like vanes 221, 222 that are radially arranged around the central axis 10 of the anode cylinder 211, a plurality of strap rings 31, 32 for electrically connecting the plate-like vanes alternately, the cooling jacket 40 arranged in an outer peripheral part of the anode cylinder 211 and the antenna 7 for emitting microwaves one end of which is connected to any one of the plate-like vanes 221, 222.

As shown in FIG. 6 to FIG. 8, the anode cylinder 211 includes refrigerant flow paths 212, 213 for directly applying a refrigerant (cooling liquid) to the plate-like vanes 221, 222. Specifically, the anode cylinder 211 includes the refrigerant flow paths 212, 213 for directly supplying the refrigerant to the plate-like vanes 221, 222 so as to match positions corresponding to fixed portions of the plate-like vanes 221, 222 and shapes thereof. In the present embodiment, the refrigerant flow paths 212, 213 are holes at upper and lower two places communicating with clearances 223 (flow path in vanes) (described later) inside the plate-like vanes 221, 222.

As shown in FIG. 6 and FIG. 7, an even number of plate-like vanes 221, 222 are arranged radially and at equal intervals with respect to the central axis 10 of the anode cylinder body 211, and closely contact the inner peripheral part of the anode cylinder 211. The plate-like vanes 221, 222 extend from the vicinity of the central axis 10 almost radially and fixed to an inner face (inner peripheral part) of the anode cylinder body 211.

The plate-like vanes 221, 222 are respectively formed inside a substantially rectangular plate shape. End faces (free ends) 221*a*, 222*a* of the plate-like vanes 221, 222 on the side not fixed to the inner face of the anode cylinder 211 are arranged on the same cylinder surface extending along the central axis 10.

In particular, the rectangular-shaped clearances 223 for allowing the cooling liquid to pass thereinside are demarcated in the plate-like vanes 221, 222. The clearances 223 form refrigerant flow paths. The clearances 223 provided inside the plate-like vanes 221, 222 may have any shape. The clearances 223 can be fabricated as follows. For example, prior to the joining of the plate-like vanes 221, 222, the inside of the plate-like vanes 221, 222 is excavated from the end faces 221*b*, 222*b* (joint end faces on an inner-peripheral portion fixed side of the anode cylinder 211) to thereby form the rectangular-shaped clearances 223. Then, the corresponding end faces of the plate-like vanes 221, 222 in which the clearances 223 are formed are joined to the inner peripheral part of the anode cylinder 211.

As shown in FIG. 8, the clearances 223 for allowing the cooling liquid to pass thereinside open toward the inner face (inner peripheral part) of the anode cylinder 211 in the plate-like vanes 221, 222. In the anode cylinder 211, circular holes (refrigerant flow paths 212, 213) for allowing the coolant to pass are opened at two places inside a contact face with respect to each of plate-like vanes 221, 222. The above structure is the same in all contact faces between all the plate-like vanes 211, 222 and the anode cylinder 211. That is, in the case where the number of the plate-like vanes 221, 222 is 10-pieces, 10 holes each in upper and lower parts, namely, a sum total of 20 circular holes (refrigerant flow paths 212, 213) open in the anode cylinder 211.

As shown in FIG. 6, the cooling jacket 40 is arranged in an outer peripheral part of the anode cylinder 211. The cooling jacket 40 includes the annular jacket upper plate 41, the annular jacket middle plate 42, the annular jacket lower plate 43 and the jacket outer cylinder 44. Components of the cooling jacket 40 are joined to one another, and the cooling jacket 40 and the anode cylinder 211 are joined respectively. In the jacket outer cylinder 44, the feed port 45 from which the refrigerant (cooling liquid) is supplied and the outlet port 46 from which the circulated refrigerant is discharged are formed at upper and lower two places of the jacket middle plate 42.

Hereinafter, a cooling operation of the magnetron 200 configured as described above will be explained.

As shown in FIG. 6, the cooling liquid flows into the feed port 45 of the jacket outer cylinder 44 of the cooling jacket 40 flows into an annular water passage formed by the jacket upper plate 41, the jacket middle plate 42, the jacket outer tube 44 and the anode cylinder 211.

The cooling liquid flowing into the annular water passage flows into all the upper-side circular holes (refrigerant flow paths 212) in parallel in the circular holes (refrigerant flow paths 212, 213) opened in the anode cylinder 211. Then, after the cooling liquid flows into the clearances 223 inside all the plate-like vanes 221, 222 in parallel, the cooling liquid flows into all the lower-side circular holes (refrigerant flow paths 213) in parallel in the circular holes (refrigerant flow paths 212, 213) opened in the anode cylinder 211, then, the cooling liquid flows into the annular water passage formed by the jacket middle plate 42, the jacket lower plate 43, the jacket outer cylinder 44 and the anode cylinder 211, and finally discharged from the outlet port 46 of the jacket outer cylinder 44.

The clearances 223 to be the refrigerant flow paths are provided inside the plate-like vanes 221, 222 in the present embodiment, thereby directly supplying the refrigerant into the plate-like vanes 221, 222 and cooling the plate-like vanes 221, 222 with the highest heating value more effectively.

As shown in FIG. 5, it is confirmed that the saturation temperature is improved 10% in the first embodiment (see symbols □ in FIG. 5) with respect to the related-art example (see symbols ◇ in FIG. 5). In the second embodiment, further improvement of 30% is confirmed (see symbols Δin FIG. 5). In particular, it is suitable to be applied to the high-output type magnetron with an output of 10 kW or more.

A magnetron 200 according to the present embodiment can be applied to magnetrons with any output without changing the structure in the same manner as the first embodiment, therefore, the invention can respond to output change or change in application conditions as well as replacement (displacement) that may occur in the future, and versatility can be drastically increased.

Here, at the time of operation of the magnetron, a high-frequency electric field generated in the anode tube is taken out by the antenna 7 and is outputted to the outside as microwaves. The present embodiment adopts the structure of providing the clearances 223 to be the flow paths inside the plate-like vanes 221, 222, therefore, the appearance shape of the plate-like vanes 221, 222 is the same as plate-like vanes 21, 22 (see FIG. 4). In particular, surfaces of the plate-like vanes 221, 222 are planarized without unevenness even when the clearances 223 are provided, therefore, microwaves generated in the anode tube are not leaked to the input side.

[Modification Example 1]

Figure 9:
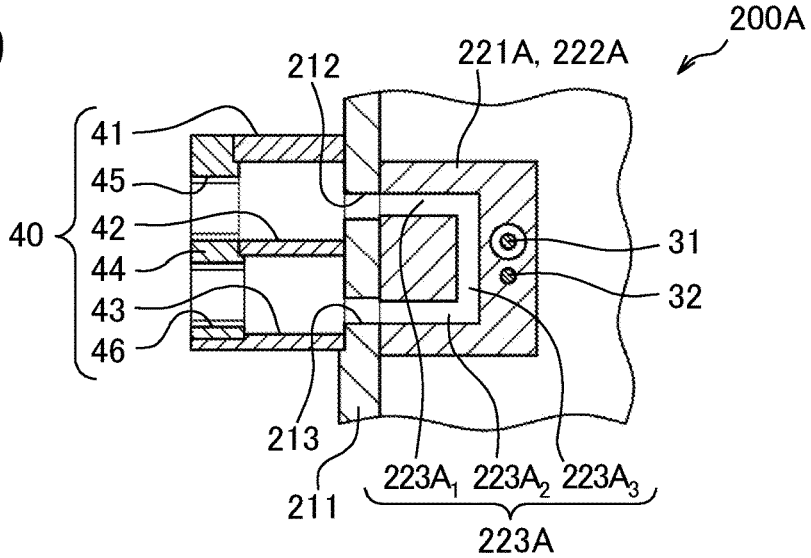
FIG. 9 is a view showing Modification example 1 of the magnetron according to the above-mentioned second embodiment.
Figure 10:
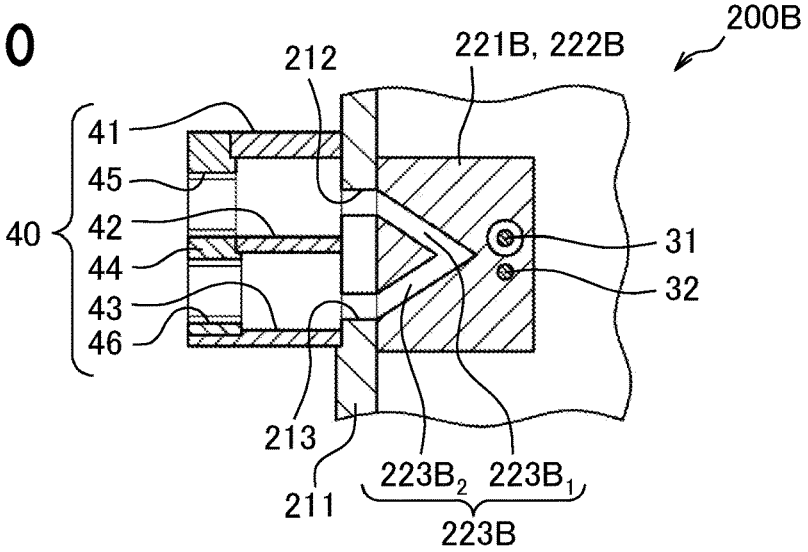
FIG. 10 is a view showing Modification example 2 of the magnetron according to the above-mentioned second embodiment.

FIG. 9 and FIG. 10 are views showing modification examples of the magnetron according to the second embodiment.

<Modification Example 1>

As shown in FIG. 9, a magnetron 200A according to a modification example 1 includes a cylindrical anode cylinder 211, plural plate-like vanes 221A, 222A that are radially arranged around the central axis 10 of the anode cylinder 211.

Refrigerant flow paths 223A (communicating paths, flow paths in vanes) for allowing the cooling liquid to pass thereinside are formed in the plate-like vanes 221A, 222A. The refrigerant path 223A has a C-shape in a cross-sectional view, openings of which communicate with the refrigerant flow paths 212, 213 of the anode cylinder 211. As shown in FIG. 9, the refrigerant flow path 223A is arranged so as to be close to corners along three edges of plate-like vanes 221A, 222A.

The refrigerant paths 223A can be fabricated as follows. For example, horizontal communication holes 223$A_1$, 223$A_2$ are drilled (excavated) in parallel to each other inside each of the plate-like vanes 221A, 222A from upper and lower two places in end faces (joint end faces on an inner peripheral portion fixed side of the anode cylinder 211) of the plate-like vanes 221A, 222A, and further, vertical communication holes 223$A_3$ is drilled inside from each of bottom surfaces of the plate-like vanes 221A, 222A so as to allow end portions of the two horizontal communication holes 223$A_1$, 223$A_2$ to communicate with each other in the vertical direction. The bottom surfaces of the plate-like vanes 221A, 222A on which the vertical communication holes 223$A_3$ are opened are blocked by vane plugs (not shown). Surfaces of the vane plugs are buried so as to be flush with the bottom surfaces of the plate-like vanes 221A, 222A. As a machining cost of the excavation is high, it is also preferable to fabricate the plate-like vanes 221A, 222A having the refrigerant flow paths 223A by using a metal mold.

As shown in FIG. 9, the refrigerant flow paths 223A for allowing the cooling liquid to pass thereinside open to the inner face (inner peripheral part) of the anode cylinder 211 in the plate-like vanes 221A, 222A. In the anode cylinder 211, circular holes (refrigerant flow paths 212, 213) for allowing the coolant to pass are opened at two places inside a contact face with respect to each of the plate-like vanes 221A, 222A. Openings at upper and lower two places of the refrigerant flow path 223A in each of the plate-like vanes 221A, 221B communicate with the refrigerant flow paths 212, 213 of the anode cylinder 211. The above structure is the same in all contact faces between all the plate-like vanes 221A, 222A and the anode cylinder 211.

In the above structure, as shown in the above FIG. 6, the cooling liquid flows into the feed port 45 of the jacket outer cylinder 44 of the cooling jacket 40 flows into the annular water passage formed by the jacket upper plate 41, the jacket middle plate 42, the jacket outer tube 44 and the anode cylinder 211.

The cooling liquid flowing into the annular water passage flows into all the upper-side circular holes (refrigerant flow paths 212) in parallel in the circular holes (refrigerant flow paths 212, 213) opened in the anode cylinder 211. Then, as shown in FIG. 9, after the cooling liquid flows into the refrigerant paths 223A inside all the plate-like vanes 221A, 222A in parallel, the cooling liquid flows into all the lower-side circular holes (refrigerant flow paths 213) in parallel in the circular holes (refrigerant flow paths 212, 213) opened in the anode cylinder 211. After that, the cooling liquid flows into the annular water passage formed by the jacket middle plate 42, the jacket lower plate 43, the jacket outer cylinder 44 and the anode cylinder 211, and finally discharged from the outlet port 46 of the jacket outer cylinder 44 as shown in FIG. 6.

In the modification example 1, the refrigerant paths 223A are provided inside the plate-like vanes 221, 222, thereby directly supplying the refrigerant into the plate-like vanes 221A, 222A in the same manner as the second embodiment, and cooling the plate-like vanes 221A, 222A with the highest heating value further effectively.

The bottom surfaces of the plate-like vanes 221A, 222A in which the vertical communication holes 223$A_3$ are opened are planarized as described above, therefore, microwaves generated in the anode tube are not leaked to the input side.

Moreover, the refrigerant flow paths 223A can be formed to be wider as compared with later-described Modification Example 2. More specifically, the refrigerant flow paths 223A can be formed close to four corners so as to correspond to the shape of the rectangular plate-like vanes 221, 222, therefore, the plate-like vanes 221A, 222A can be cooled further effectively.

[Modification Example 2]

As shown in FIG. 10, a magnetron 200B according to a modification example 2 includes the cylindrical anode cylinder 211 and plural plate-like vanes 221B, 222B that are radially arranged around the central axis 10 of the anode cylinder 211.

Refrigerant flow paths 223B (communicating paths, flow paths in vanes) for allowing the cooling liquid to pass thereinside are formed in the plate-like vanes 221B, 222B. The refrigerant flow path 223B has a V-shape in a cross-sectional view, openings of which communicate with the refrigerant flow paths 222, 223 of the anode cylinder 211. The refrigerant flow paths 223B are respectively inclined in directions away from facing upper and lower two edges of each of the plate-like vanes 221B, 222B and intersect thereinside.

The refrigerant flow paths 223B can be fabricated as follows. For example, horizontal communication holes 223$B_1$, 223$B_2$ inclined to the inside so as to descend/ascend from upper and lower two places on end surfaces (end faces on an inner-peripheral portion fixed side of the anode cylinder 211) of the plate-like vanes 221B, 222B are drilled (excavated). It is also preferable to fabricate the plate-like vanes 221B, 222B having the refrigerant flow path 223B by using a low-cost metal mold. End portions of the two horizontal communication holes 223$B_1$, 223$B_2$ intersect with each other inside each of the plate-like vanes 221B, 222B to form the V-shape refrigerant flow path 223B.

In Modification Example 2, the refrigerant flow paths 223B are provided inside the plate-like vanes 221B, 222B, thereby directly supplying the refrigerant to the inside of the plate-like vanes 221B, 222B in the same manner as the second embodiment, and cooling the plate-like vanes 221B, 222B with the highest heating value further effectively.

Moreover, the refrigerant flow paths 223B are formed by drilling (excavating) only end faces of the plate-like vanes 221B, 222B in Modification Example 2, therefore, the appearance shape of the plate-like vanes 221B, 222B is the same as plate-like vanes 21, 22 (see FIG. 4). Though it is necessary to planarize the bottom surfaces of the plate-like vanes 221A, 222A in which the vertical communication holes 223$A_3$ (see FIG. 9) are opened in the above Modification Example 1, the V-shaped refrigerant flow paths 223B are formed inside the plate-like vanes 221B, 222B in Modification Example 2, therefore, bottom surfaces of the plate-like vanes 221B, 222B are already held flat. As the bottom surfaces are planarized without unevenness caused by providing the refrigerant flow path 223B, therefore, microwaves generated inside the anode tube are not leaked to the input side.

The present invention is not limited to the structures described in respective embodiments and modification examples, and may be modified appropriately in a range not departing from the gist of the present invention described in claims.

For example, the material, the shape, the structure and so on of the plate-like vanes and the strap rings as well as the shape, the number of arrangement and so on of the refrigerant flow paths and the flow paths in vanes are one examples and any kind of them may be adopted.

The respective embodiments have been explained in detail for making the present invention easy to understand, and are not always limited to one including all the explained components. It is possible to replace part of components of a certain embodiment with components of another embodiment, and it is also possible to add part of components of another embodiment to components of a certain embodiment. Furthermore, other components may be added/deleted/replaced with respect to part of components of respective embodiments.

REFERENCE SIGNS LIST

1 vacuum tube portion
3 annular magnet
4 magnetic pole
5 frame yoke
6 filter circuit portion
7 antenna
8 antenna cover
10 central axis
11, 211 anode cylinder
12 cathode
21, 22, 221, 222, 221A, 222A, 221B, 222B, plate-like vane
21*a*, 22*a*, 221*a*, 222*a* end face (free end) of plate-like vane
21*b*, 22*b*, 221*b*, 222*b* end face (joint end face) of plate-like vane
31, 32 strap ring
40 cooling jacket (cooling portion, refrigerant supply portion)
41 jacket upper plate
42 jacket middle plate
43 jacket lower plate
44 jacket outer tube
45 feed port
46 outlet port
100, 200, 200A, 200B magnetron
111, 212, 213 refrigerant flow path (hole, communicating path, flow path in vane)
223 clearance (flow path in vane)
223A, 223B refrigerant flow path (communicating path, flow path in vane)

The invention claimed is:

1. A magnetron comprising:
an anode cylinder extending in a cylindrical shape along a central axis; and
a plurality of plate-like vanes at least each one end of which is fixed to the anode cylinder, extending from an inner face of the anode cylinder toward the central axis,
wherein the anode cylinder includes refrigerant flow paths for directly applying a refrigerant to the plate-like vanes, and
the refrigerant flow paths are openings formed so that end portions of the plate-like vanes are exposed so as to match with positions corresponding to fixed portions of the plate-like vanes.

2. The magnetron according to claim 1,
wherein the refrigerant flow paths are holes opening to end portions of the plate-like vanes so as to match with positions corresponding to fixed portions of the plate-like vanes.

3. The magnetron according to claim 1,
wherein the plate-like vanes include flow paths in vanes provided in the plate-like vanes into which a refrigerant flowing in the refrigerant flow paths is introduced.

4. The magnetron according to claim 3,
wherein the flow paths in vanes are clearances opening to the refrigerant paths.

5. The magnetron according to claim 2,
wherein the flow paths in vanes are communication paths communicating with the holes.

6. The magnetron according to claim 5,
wherein the plate-like vanes have a rectangular shape, and
the communication paths are arranged so as to be close to corners along edges of each plate-like vane.

7. The magnetron according to claim 5,
wherein the plate-like vanes have a rectangular shape, and the communication paths are arranged so as to be respectively inclined in directions away from facing upper and lower two edges of each plate-like vane and intersect thereinside.

8. The magnetron according to claim 1, further comprising:

a refrigerant supply portion supplying a refrigerant to the refrigerant flow paths and collecting the refrigerant from the refrigerant flow paths.

9. The magnetron according to claim 8, wherein the refrigerant supply portion includes a cooling jacket arranged closely to an outer peripheral wall of the anode cylinder and supplying a refrigerant along the refrigerant flow paths arranged thereinside in a tube axis direction of the anode cylinder.

10. The magnetron according to claim 1, wherein the refrigerant flow paths are only formed outside of the plurality of plate-like vanes.

11. The magnetron according to claim 1, wherein the anode cylinder maintains a vacuum state.

* * * * *